US011710932B2

(12) United States Patent
Listing et al.

(10) Patent No.: US 11,710,932 B2
(45) Date of Patent: Jul. 25, 2023

(54) SHIELDING SPRING SHELL FOR HIGH CURRENT PLUG-IN CONNECTIONS

(71) Applicant: TE Connectivity Germany GmbH, Bensheim (DE)

(72) Inventors: Martin Listing, Bensheim (DE); Bernd Leonhardt, Bensheim (DE); Maximilian Veihl, Bensheim (DE); Christoph Kosmalski, Bensheim (DE); Jürgen Sauer, Bensheim (DE); Soenke Sachs, Bensheim (DE); Jochen Fertig, Bensheim (DE); Ivan Ivanov, Bensheim (DE); Marco Wolf, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 30 days.

(21) Appl. No.: 17/160,957

(22) Filed: Jan. 28, 2021

(65) Prior Publication Data

US 2021/0234312 A1 Jul. 29, 2021

(30) Foreign Application Priority Data

Jan. 28, 2020 (DE) ..... 10 2020 200 976.7

(51) Int. Cl.

| | |
|---|---|
| ***H01R 13/6582*** | (2011.01) |
| ***H01R 13/6583*** | (2011.01) |
| *H01R 24/52* | (2011.01) |
| *H01R 13/6581* | (2011.01) |
| *H01R 24/54* | (2011.01) |
| *H01R 13/658* | (2011.01) |

(52) U.S. Cl.

CPC ..... *H01R 13/6582* (2013.01); *H01R 13/6583* (2013.01); *H01R 13/658* (2013.01); *H01R 13/6581* (2013.01); *H01R 24/52* (2013.01); *H01R 24/54* (2013.01)

(58) Field of Classification Search

CPC ..... H01R 13/6582; H01R 13/6583; H01R 13/658; H01R 13/6581; H01R 24/52; H01R 24/54

See application file for complete search history.

(56) References Cited

U.S. PATENT DOCUMENTS

| | | | |
|---|---|---|---|
| 7,238,047 B2 | 7/2007 | Saettele et al. | |
| 7,587,244 B2 | 9/2009 | Olbertz | |

FOREIGN PATENT DOCUMENTS

| | | | | |
|---|---|---|---|---|
| DE | 4212007 A1 | * | 10/1993 | ..... H01R 13/65802 |
| DE | 4212007 A1 | | 10/1993 | |
| DE | 10 2004 017 659 A1 | | 10/2005 | |
| DE | 10 2005 034 497 A1 | | 2/2007 | |
| EP | 3168938 A1 | | 5/2017 | |

OTHER PUBLICATIONS

German Office Action, dated Oct. 1, 2020 6 pages.
Extended European Search Report, dated Jun. 4, 2021, 10 pages.
Abstract of DE 4212007, dated Oct. 14, 1993, 2 pages.

* cited by examiner

*Primary Examiner* — Abdullah A Riyami
*Assistant Examiner* — Justin M Kratt
(74) *Attorney, Agent, or Firm* — Barley Snyder

(57) ABSTRACT

A shielding spring shell has a contact tab with a pair of spring sections adjoining a fillet. One of the spring sections is an at least radially resilient radial spring and another of the spring sections is an at least axially resilient axial spring.

20 Claims, 4 Drawing Sheets

SHIELDING SPRING SHELL FOR HIGH CURRENT PLUG-IN CONNECTIONS

CROSS-REFERENCE TO RELATED APPLICATION

This application claims the benefit of the filing date under 35 U.S.C. § 119(a)-(d) of German Patent Application No. 102020200976.7, filed on Jan. 28, 2020.

FIELD OF THE INVENTION

The present invention relates to a shielding spring shell and, more particularly, to a shielding spring shell for a high current plug-in connection.

BACKGROUND

Shielding is essential to ensure electromagnetic compatibility of a system. The shielding is used to keep electrical and/or magnetic fields away from the system or to protect the environment from the fields emanating from the system. In order to ensure the shielding in plug-in systems during operation, continuous contact of the shielding of the connector to the mating connector, in particular for shielding the mating connector, is important. The continuous contact, however, proves to be difficult because high stresses in use, for example vibrations, can lead to interruptions of the contact.

SUMMARY

A shielding spring shell has a contact tab with a pair of spring sections adjoining a fillet. One of the spring sections is an at least radially resilient radial spring and another of the spring sections is an at least axially resilient axial spring.

BRIEF DESCRIPTION OF THE DRAWINGS

The invention will now be described by way of example with reference to the accompanying Figures, of which.

DETAILED DESCRIPTION OF THE EMBODIMENT(S)

In the following, the invention will be described in more detail using embodiments with reference to the appended figures. Elements in the figures that correspond to one another in terms of structure and/or function are provided with the same reference symbols. The combinations of features shown and described in the individual embodiments are for explanatory purposes only. A feature of an embodiment may be dispensed with if its technical effect is of no significance in a particular application. Conversely, a further feature may be added in an embodiment should its technical effect be advantageous or necessary for a particular application.

Figure 2:
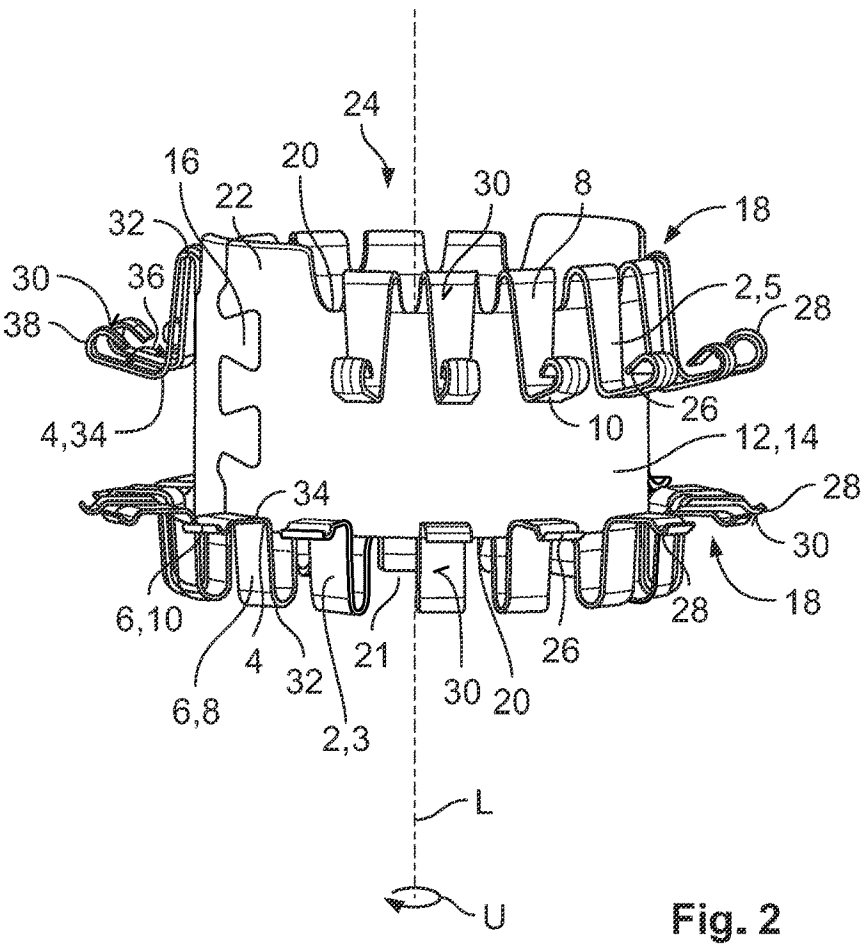
FIG. 2 is a perspective view of the shielding spring shell of FIG. 1 with contacts tabs at both ends bent over.
Figure 1:
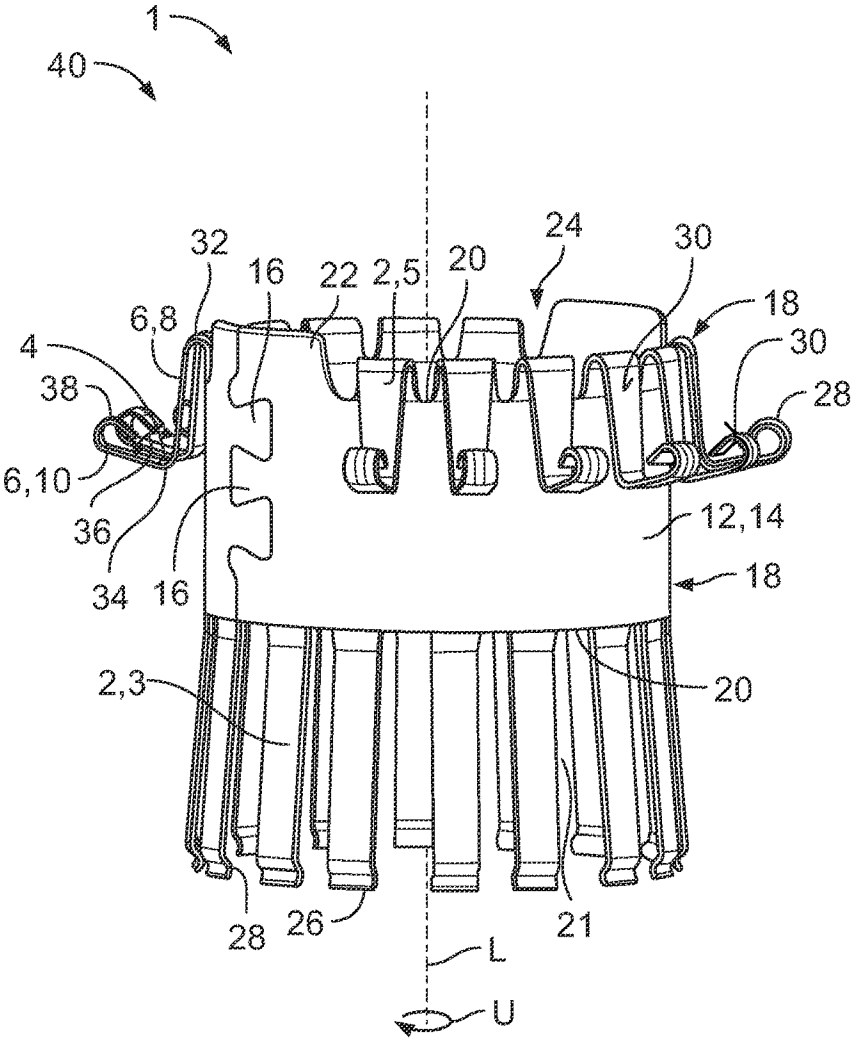
FIG. 1 is a perspective view of a shielding spring shell according to an embodiment.

A shielding spring shell 1 according to an embodiment is shown in FIGS. 1 and 2. The shielding spring shell 1 comprises at least one contact tab 2 with two spring sections 6 adjoining a fillet 4, wherein one of two spring sections 6 is configured as an at least radially resilient radial spring 8 and another of two spring sections 6 as an at least axially resilient axial spring 10.

At least radially resilient or at least axially resilient within the meaning of the application means that the radial spring 8 can be mainly radially resilient, i.e. that a spring strength of the radial spring 8 can be the lowest in the radial direction, or that the axial spring 10 can be configured to be mainly axially resilient, i.e., a spring strength of the axial spring 10 is the lowest in the axial direction. Of course, the radial spring 8 can also be axially resilient or the axial spring 10 can also be radially resilient, for example, the respective springs can be deflected resiliently in the axial direction or in the radial direction, respectively, due to static friction at a pressing surface arranged on a mating connector.

The shielding spring shell 1, as shown in FIGS. 1 and 2, may comprise a shell body 12 extending along a longitudinal axis L. Shell body 12 may be, for example, a piece of sheet metal 14 assembled having an annular shape. The piece of sheet metal 14 may be punched out in a punching and bending process and assembled having an annular shape. For this purpose, the piece of sheet metal 14 may comprise interlocking teeth 16 on its end edges pointing in a circumferential direction U, wherein the teeth 16 establish a positive-fit connection, in particular a dovetail connection, in the circumferential direction U.

In the exemplary embodiment shown in FIGS. 1 and 2, a plurality of contact tabs 2 are arranged in a crown-shaped manner at respective ends 18, wherein the contact tabs 2 extend away from a respective edge 20 of ends 18 and adjacent contact tabs 2 are spaced from one another in the circumferential direction U, so that a slot 21 is formed between contact tabs 2 that are disposed adjacent in circumferential direction U.

The arrangement of contact tabs 2 at the respective ends 18 is independent of the arrangement of contact tabs 2 at oppositely disposed end 18. The position, number, and/or shape of contact tabs 2 at the respective ends may differ. In the figures, two embodiments of a contact tab 2 according to the invention on a shielding spring shell 1 are shown by way of example which shall be described below as the first embodiment of contact tab 3 and the second embodiment of contact tab 5.

As is shown by way of example in FIGS. 1 and 2, the shell body 12 may be provided with a reinforcing tab 22 protruding from one end along longitudinal axis L to stabilize the connection region between the edges in circumferential direction U. This reinforcing tab 22 may interrupt the arrangement of contact tabs 2 at one of two ends 18. For better stabilization of the shell body 12 in its cylindrical shape, a further reinforcing tab 22 may be provided substantially diametrically to the first reinforcing tab 22.

In the exemplary embodiment shown in FIGS. 1 and 2, the shielding spring shell 1 at its end 18 facing away from reinforcing tabs 22 has the first embodiment of contact tabs 3 which extend substantially along the longitudinal axis L away from the edge 20, at least prior to shielding spring shell 1 being inserted into a receptacle of a connector (see FIG. 1). As a result, contact tabs 3 according to the first embodiment may be pushed through the receptacle more easily. These contact tabs 2 may be, for example, bent over by a die after shielding spring shell 1 has been inserted into the receptacle, whereby radial spring 8 and axial spring 10 are formed, as shown in FIG. 2. The shell body 12 may serve as a stop for limiting the motion of the radial spring 8 in the radial direction.

In order to simplify the bending over of contact tabs 3, contact tabs 3 may extend away from edge 20 at a radially outwardly inclined angle along longitudinal axis L prior to bending. As a result, an opening 24 described by shielding spring shell 1 may widen conically in the direction toward a free end 26 of contact tabs 3. At free end 26 of contact tabs 3, which is formed by axial spring 10 after bending, contact tab 3 may have a bulge 28 that bulges radially inward at least prior to bending. A contact surface 30 may be formed on bulge 28 for contacting a pressing surface of a mating connector to preload the axial spring 10 in a direction toward the pressing surface of the mating connector.

The first embodiment of contact tab 3 is shown in FIG. 1 prior to bending and in FIG. 2 after bending. As can be seen in particular in FIG. 1, contact tab 3 according to the first embodiment may have a substantially uniform width in circumferential direction U. Depending on the employment and type of mating connector, the spring force of radial spring 8 and axial spring 10 may be adapted individually by the shape of the contact tab 2 and/or the preload of the respective spring in the radial or axial direction, respectively.

Contact tab 3 according to the first embodiment may be bent back radially outwardly in the direction toward edge 20 from which respective contact tab 3 extends away by a first arc 32, wherein radial spring 8 extends away from the first arc 32. Radial spring 8 may extend away from first arc 32 at an angle inclined radially outwardly from longitudinal axis L, i.e. radial spring 8 may be preloaded radially outwardly over first arc 32. At its end facing away from first arc 32, radial spring 8 flows into a second arc 34 by which fillet 4 is formed and from which the axial spring 10 extends away substantially in the radial direction. An angle 36 of the fillet 4 between radial spring 8 and axial spring 10, in an embodiment, is at most about 90°, and may be between 45° and 90°. Axial spring 10 extends substantially in the radial direction away from fillet 4, wherein contact surface 30 is formed on bulge 28 which is pronounced in the direction away from oppositely disposed end 18, at least after bending.

The second embodiment of contact tab 5 in FIGS. 1 and 2 is arranged at end 18 with reinforcing tab 22. In contrast to the first embodiment of contact tab 3, this contact tab 5 according to the second embodiment does not have to be pushed through the receptacle of the connector. Therefore, contact tab 5 may be bent over at end 18 with the reinforcing tab 22 already prior to shielding spring shell 1 being inserted into the receptacle of the connector.

Contact tab 5 according to the second embodiment is bent back radially outwardly by a first arc 32 in the direction toward end 18 from which contact tab 5 extends away. In order to increase the spring rigidity of contact tab 5, contact tab 5 may taper in circumferential direction U in the direction away from edge 20. Contact tab 5 may taper up to fillet 4, in particular in spring section 6 forming radial spring 8, and axial spring 10 may extend substantially radially outwardly away from fillet 4 at a uniform width in circumferential direction U. Compared to the first embodiment, angle 36 of the fillet is more acute in the second embodiment, which results in a greater preload of axial spring 10 in the axial direction away from opposite end 18 of shell body 12.

The free end 26 of axial spring 10 in the second embodiment of contact tab 5 shown in FIGS. 1 and 2 is bent back in the direction toward fillet 6, as a result of which contact surface 30 is formed on a third arc 38. According to the second embodiment, a relative motion between the connector and the mating connector in the axial direction may therefore be compensated for, firstly, by the deflection around third arc 38 and by the deflection of axial spring 10 around second arc, i.e. the fillet 6.

Both embodiments of contact tab 2, in an embodiment, have a radial spring 8 having a yielding contact surface 30 pointing in the radial direction and an axial spring 10 having a yielding contact surface 30 pointing in the axial direction. As a result, relative motions of the mating connector and the connector in the axial direction and in the radial direction may be compensated for more reliably.

Shielding spring shell 1 may be formed integrally as a monolithic component 40, whereby shielding currents may be conducted through the shielding spring shell 1 without additional contact resistances. The shielding spring shell 1 may be shaped, for example, as a punched and bent member which enables inexpensive and fast production, in particular in large numbers.

If the spring force of the radial spring 8 is to be further increased, then the radial spring 8 may be provided with a spring tab extending in the direction toward the jacket surface of the shell body 12 and supportable on the jacket surface. As a result, the radial spring 8 is not only determined in the radial direction by the arc between the radial spring 8 and the edge of the shell body 12, but also improved by the spring tab.

Figure 3:
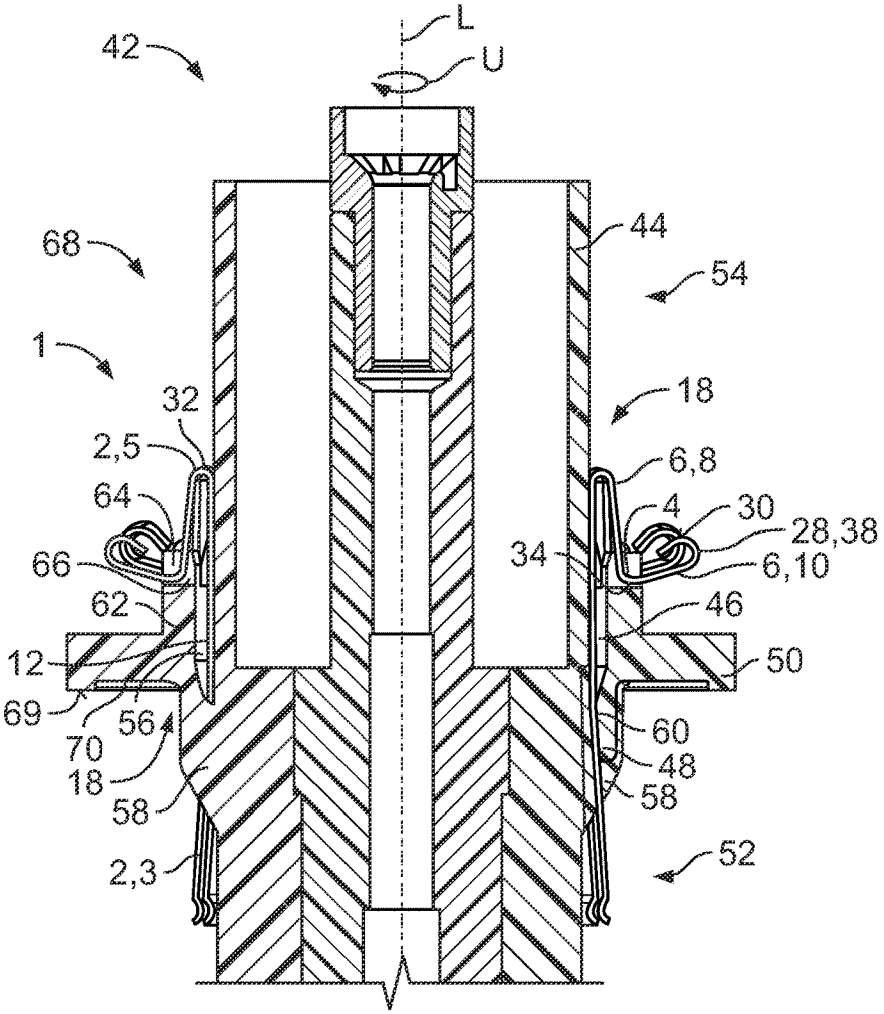
FIG. 3 is a sectional side view of a connector with the shielding spring shell.

An exemplary embodiment of a connector 42 shall now be explained in more detail below with reference to FIGS. 3 and 4. In FIG. 3, the first embodiment of contact tab 3 is not yet bent over and in FIG. 4, the first embodiment of contact tab 3 is shown bent over. The connector 42 may be, for example, an adapter element that electrically couples two mating connectors to one another. For example, the connector may be a connector interface which may be inserted into an opening of an element to be actuated, for example, a printed circuit board, and which establishes contact with this element.

Figure 4:
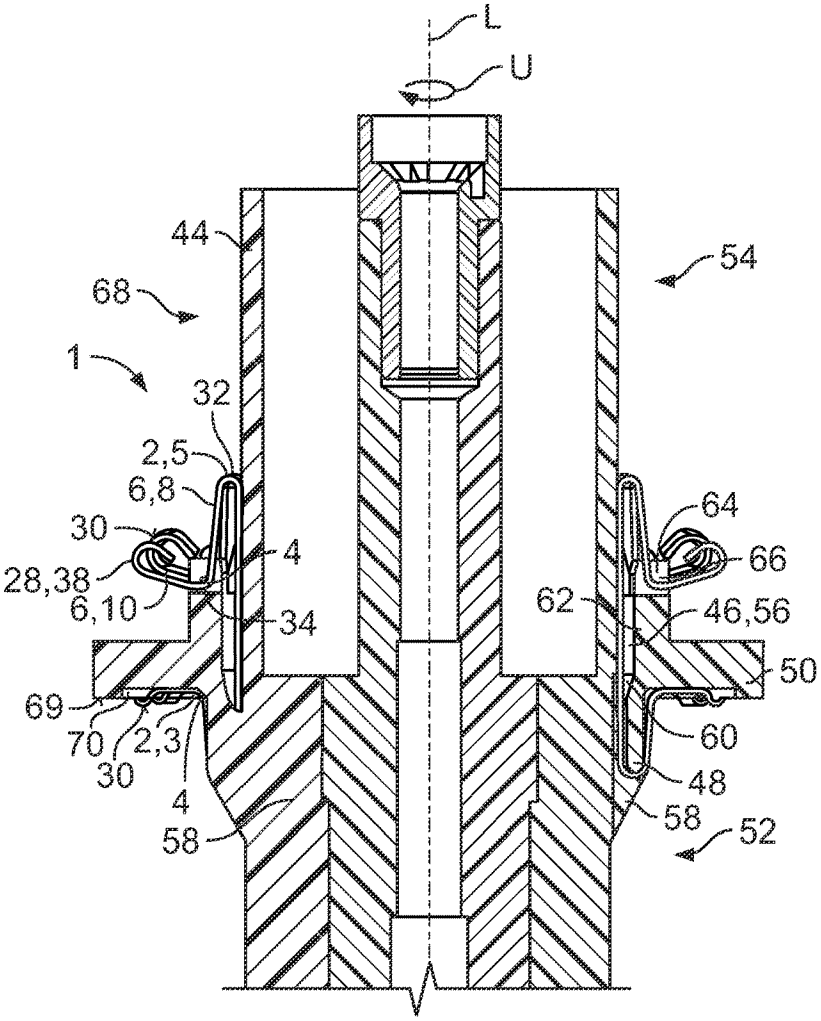
FIG. 4 is a sectional side view of the connector after the shielding spring shell has been inserted.

Connector 42, as shown in FIGS. 3 and 4, has a base body 44 extending along longitudinal axis L and a receptacle 46 into which shielding spring shell 1 is inserted. Receptacle 46 is open on both sides along longitudinal axis L so that contact tabs 3 according to the first embodiment may be pushed through receptacle 46 before being bent over. Consequently, contact tabs 2 of oppositely disposed ends 18 are arranged on oppositely disposed sides of receptacle 46 and, in the shown embodiment, protrude at least in part out from receptacle 46.

Contact tab 3 according to the first embodiment may be bent around a wall 48 of receptacle 46 (see FIG. 4), whereby wall 48 forms a support and shaping the plurality of contact tabs 3 at corresponding end 18 is facilitated, so that the plurality of contact tabs 3 have a substantially identical structure. Uniform contacting of the corresponding mating connector may thus be achieved.

Base body 44, as shown in FIGS. 3 and 4, may have a collar 50 protruding in the radial direction which divides base body 44 into a first plug-in section 52 for plugging to a first mating connector and a second plug-in section 54 for plugging to a second mating connector. Plug-in sections 52, 54 may be adapted independently of one another to the type of the respective complementary mating connector. Receptacle 46 may be formed by a gap 56 between base body 44 and collar 55, whereby inserted shielding spring shell 1 may be arranged between base body 44 and collar 50. Shielding spring shell 1 may rest at least with its shell body 12 on a jacket surface of base body 44. The shielding spring shell 1, the base body 44, and the collar 50 may primarily have substantially rotationally symmetrical shapes, for example, a cylindrical shape. The shielding spring shell 1 may be wrapped coaxially around the jacket surface of the base body 44.

In order to fasten collar 50 to base body 44, ribs 58 may be provided and extend from base body 44 to collar 50, as shown in FIGS. 3 and 4. Several ribs 58 may be spaced apart from one another in circumferential direction U and thereby in part subdivide receptacle 46 into chambers 60 separated from one another in circumferential direction U. A contact tab 3 of the first embodiment may be inserted through each chamber 60, wherein ribs 58 are arranged in slots 21 between adjacent contact tabs 2.

For stabilization, collar 50 may be provided with shoulders 62 extending along longitudinal axis L, as shown in FIGS. 3 and 4. On the side facing the ribs 58, the shoulders 62 may extend between ribs 58 in circumferential direction U and thereby stabilize ribs 58. Shoulders 62 on the side facing ribs 58 form wall 48 around which contact tabs 3 of the first embodiment may be bent. Ribs 58 protrude only in part into the receptacle 46 so that they may serve as a stop for the shielding spring shell 1 since edge 20 facing the rib 58 strikes against rib 58 and prevents the shielding spring shell 1 from being pushed deeper into receptacle 46.

On the opposite side, as shown in FIGS. 3 and 4, the shoulder 62 may comprise merlons 64 projecting along longitudinal axis L and spaced apart from one another in circumferential direction U so that one respective contact tab 5 of the second embodiment is arranged in a window 66 between two adjacent merlons 64. In particular, fillet 4 of respective contact tab 5 may be positioned in window 66.

For the most inexpensive production of connector 42, base body 44 and collar 50 may be formed integrally as a monolithic housing 68 by molding the collar 50 onto the base body 44. In an embodiment, monolithic housing 68 may be electrically insulating. For example, housing 68 may be formed as an injection-molded member from insulating plastic material. In another embodiment, the housing 68 may be formed from a metallic material.

At least one notch 70 extending in the radial direction may be provided on flat side 69 of collar 50 facing ribs 58, as shown in FIGS. 3 and 4. The notch 70 may be arranged end-to-end in circumferential direction U on flat side 69, or several notches 70 may be provided separated from one another in circumferential direction U. Axial spring 10 of respective contact tabs 3 of the first embodiment may be inserted into notch 70 so that collar 50 may rest as flat as possible on the mating connector.

Figure 5:
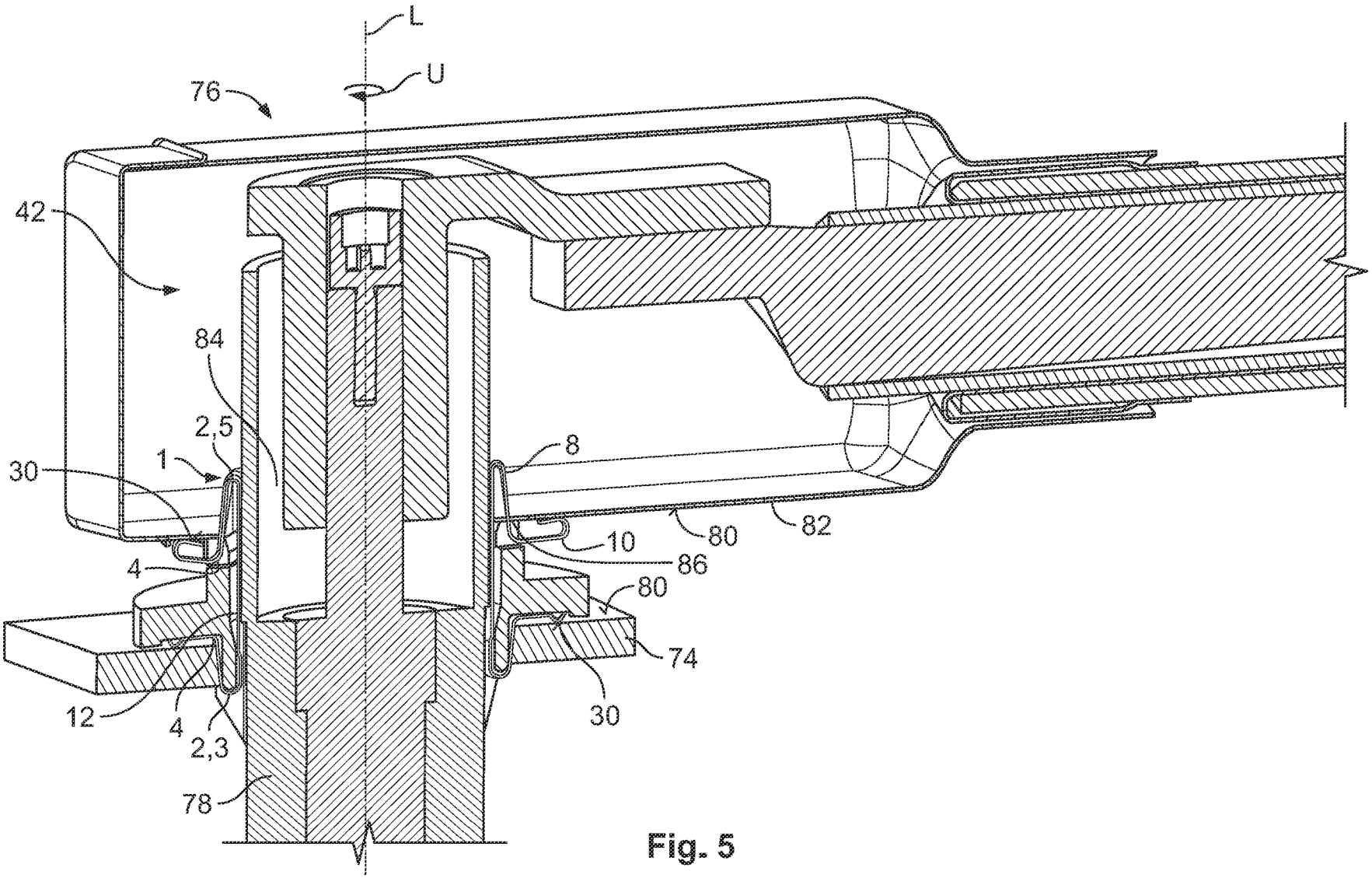
FIG. 5 is a sectional perspective view of a connector assembly according to an embodiment.
Figure 6:
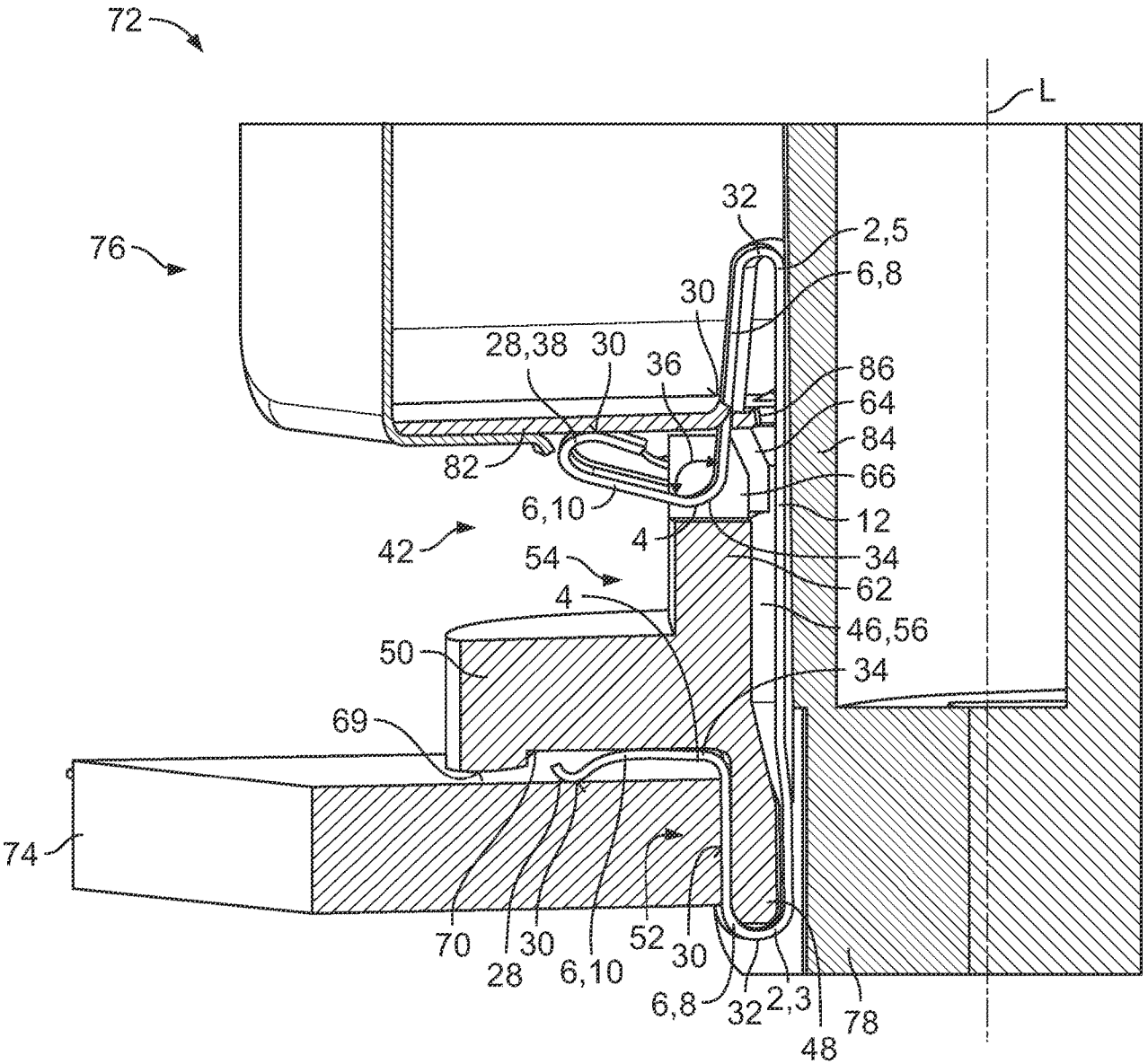
FIG. 6 is a detail sectional perspective view of a contact region of the connector assembly of FIG. 5.

FIG. 5 shows an exemplary embodiment of a connector assembly 72 with a connector 42 according to the preceding description, a first mating connector 74 that is coupled to first plug-in section 52, and a second mating connector 76 that is coupled to second plug-in section 54. FIG. 6 shows a schematic detailed view of a contact region between connector 42 and two mating connectors 74, 76. First mating connector 74 may be, for example, a switching device, in particular a printed circuit board, with an opening 78 into which first plug-in section 52 of connector 42 is arranged up to the stop of collar 50 on a first mating connector 74 surface that is substantially perpendicular to longitudinal axis L.

As can be seen in FIG. 6, radial spring 8 may establish radial contact with an inner wall of opening 78 of first mating connector 74 and axial spring 10 may rest axially on the surface of first mating connector 74. At least one contact tab 3 may then contact the first mating connector 74 on two pressing surfaces 80, whereby the quality of the shielding may be further ensured.

Second mating connector 76 may be a shielded cable connector with a connector shielding 82 comprising a receiving opening 84 into which the second plug-in section 54 is inserted at least in part, so that at least first arc 32 of at least one contact tab 5 is arranged in the interior of connector shielding 82, as shown in FIG. 2. Contact tab 5 according to the second embodiment there protrudes out from receiving opening 84 in the direction toward collar 50, wherein radial spring 8 is preloaded in the radial direction towards a border 86 of receiving opening 84. Axial spring 10 is arranged outside receiving opening 84 and is supported with a preload on a surface of connector shield 82 in the axial direction.

Motions between the mating connector 74, 76 and the connector 42 may be compensated for in both the radial and the axial direction with shielding spring shell 1 according to the invention. The mating connector 74, 76 may be contacted at two points by the contact tab 5, wherein the shielding is not impaired even when one contact disengages.

The contact tabs 2 of first and second embodiment 3, 5 may achieve different tasks. First mating connector 74 may represent a holding frame on which connector 42 is mounted, for example, by screwing or locking connector 42 to first mating connector 74. As a result, the relative motion between connector 42 and first mating connector 74 may be minimized. Since separating connector 42 and first mating connector 74 is only possible with increased effort, especially with a screw connection, contact tab 3 according to the first embodiment may contact mating connector 74 both radially and axially. As a result, two contacts to the mating connector 74 may be established for every contact tab 3 of the first embodiment.

Second mating connector 76 may be, for example, a plug connector. In an embodiment, only axial spring 10 contacts second mating connector 76 in a plugged-in initial state. In a first instance, axial spring 10 may follow a relative motion, for example, a vibration motion, of second mating connector 76 toward connector 42. Only when the spring force of axial spring 10 decreases or is too low may radial spring 8 contact second mating connector 76 in the radial direction. Radial spring 8 of contact tab 5 of the second embodiment serves not only to compensate for a relative motion between second mating connector 76 and connector 42 in the radial direction, but also as a lock that contacts second mating connector 76 in an extreme case, whereby impairment of the shielding due to the contact being dropped can be prevented.

What is claimed is:

1. A shielding spring shell, comprising:

a shell body; and a contact tab extending from the shell body and including a pair of spring sections adjoining a fillet, one of the spring sections is an at least radially resilient radial spring and another of the spring sections is an at least axially resilient axial spring located on an external portion of the shell body.

2. The shielding spring shell of claim 1, wherein the radial spring has a contact surface pointing in a radial direction.

3. The shielding spring shell of claim 2, wherein the axial spring has a contact surface pointing in an axial direction.

4. The shielding spring shell of claim 3, wherein the contact surface of the axial spring is formed on a bulge of the contact tab.

5. The shielding spring shell of claim 1, wherein an angle of the fillet between the radial spring and the axial spring is at most about 90.

6. The shielding spring shell of claim 1, wherein the shell body extends along a longitudinal axis.

7. The shielding spring shell of claim 6, wherein the contact tab extends away from an end of the shell body.

8. The shielding spring shell of claim 7, wherein the contact tab is arranged at each of a pair of opposite ends of the shell body.

9. The shielding spring shell of claim 7, wherein a plurality of contact tabs are arranged in a crown-like manner at the end of the shell body.

10. The shielding spring shell of claim 1, wherein the shielding spring shell is formed integrally as a monolithic component.

11. A connector, comprising:

a base body extending along a longitudinal axis;

a collar projecting radially relative to the base body;

a receptacle defined by a gap between the collar and the base body;

and a shielding spring shell inserted into the receptacle, the shielding spring shell has a contact tab with a pair of spring sections adjoining a fillet, one of the spring sections is an at least radially resilient radial spring and another of the spring sections is an at least axially resilient axial spring, the contact tab protrudes from the receptacle.

12. The connector of claim 11, wherein the contact tab is bent back at an end around a wall of the receptacle.

13. The connector of claim 11, wherein a flat side of the collar has a notch extending in a radial direction.

14. The connector of claim 13, wherein the axial spring is inserted into the notch.

15. The connector of claim 11, wherein the shielding spring shell has a pair of contact tabs spaced from one another in a circumferential direction.

16. The connector of claim 15, further comprising a rib arranged in a slot between the pair of contact tabs.

17. The connector of claim 11, wherein the collar and the base body are formed integrally as a monolithic housing.

18. A connector assembly, comprising:

a connector including a base body extending along a longitudinal axis, a receptacle defined at least in part by the base body, and a shielding spring shell inserted into the receptacle, the shielding spring shell has a contact tab with a pair of spring sections adjoining a fillet, one of the spring sections is an at least radially resilient radial spring and another of the spring sections is an at least axially resilient axial spring, the contact tab protrudes from the receptacle; and a mating connector plugged together with the connector, the axial spring is supported in an axial direction on the mating connector.

19. The connector assembly of claim 18, wherein the mating connector is one of a pair of mating connectors plugged at different ends of the connector.

20. The connector assembly of claim 19, wherein the shielding spring shell has at least one contact tab at each of a pair of opposite ends, the axial spring of each of the contact tabs is supported in the axial direction on one of the mating connectors.

* * * * *